United States Patent [19]

Miller et al.

[11] 4,346,824

[45] Aug. 31, 1982

[54] ICE DISPENSING MECHANISM

[75] Inventors: Benjamin D. Miller; Albert L. Schafer, both of Chicago, Ill.

[73] Assignee: Remcor Products Company, Franklin Park, Ill.

[21] Appl. No.: 131,990

[22] Filed: Mar. 20, 1980

[51] Int. Cl.[3] ..... B67D 3/00

[52] U.S. Cl. ..... 222/504; 222/517; 251/138

[58] Field of Search ..... 222/504, 505, 511, 559, 222/561, 146 C, 517–518; 221/15; 241/DIG. 17; 251/138, 78

[56] References Cited

U.S. PATENT DOCUMENTS

| | | | |
|---|---|---|---|
| 3,211,338 | 10/1965 | Weil et al. | 222/146 C |
| 3,955,792 | 5/1976 | Cho | 251/138 |
| 4,019,714 | 4/1977 | Kemmerer | 251/138 |
| 4,139,126 | 2/1979 | Krasner et al. | 222/504 |

*Primary Examiner*—H. Grant Skaggs
*Attorney, Agent, or Firm*—Gary, Juettner & Pyle

[57] ABSTRACT

An improved ice dispensing mechanism for an ice hopper is characterized by a door or gate which is moved by a variable force to cover and uncover an opening in the hopper. A lever is pivotally mounted at one end and connected at an opposite end with the door, and a solenoid plunger is coupled through a spring with a medial portion of the lever, such that actuation of the solenoid retracts the plunger to extend the spring in one embodiment, and to compress the spring in another, to exert a variable force on the lever to pivot the lever and open the door. Should the door be stuck closed because of ice pressure, by virtue of the spring minimum retraction forces are initially encountered by the plunger when the solenoid is initially energized and the plunger fully extended. This enables the plunger to move into the solenoid, whereupon increased forces are exerted on the plunger by the solenoid, and therefore on the spring, to free the door. Consequently, full solenoid power may always be developed to open the door.

6 Claims, 8 Drawing Figures

ICE DISPENSING MECHANISM

BACKGROUND OF THE INVENTION

The present invention relates to ice handling apparatus, and in particular to an ice dispensing mechanism for an ice hopper.

It is desirable in the food and beverage service industries to provide means for expeditiously dispensing a quantity of ice, for example into a glass, to facilitate service of ice water and cold beverages to customers. Conventionally, the means comprises an ice dispenser, which for commercial applications usually includes a hopper for storing a quantity of crushed, cracked, flaked or cubed ice, an icemaker for manufacturing ice for the hopper, a thermostat in the hopper in proximity to the point of entry of ice for sensing the level of ice, and an agitator for the mass of ice to prevent congealing or agglomeration in order to maintain the ice particles in discrete, free flowing form. An opening at the bottom of the hopper enables ice to be removed from the hopper, usually by a dispensing mechanism which is operable to selectively open or close the hopper opening.

Dispensing mechanisms for hoppers may be of any desired type, for example as disclosed in U.S. Pat. Nos. 3,165,901 and 3,217,509, which automatically dispense a measured quantity of ice. In some cases, however, it is desirable to selectively control the quantity of ice dispensed, and perhaps to dispense varying quantities, each and every time that ice is dispensed. For the purpose, door or gate type dispensers have been developed, and usually comprise a door or gate movable to uncover a dispensing opening in an ice hopper for as long as it is desired to dispense ice.

One form of door or gate type ice dispensing mechanism is disclosed in U.S. Pat. No. 3,211,338. As disclosed therein, one end of a lever connects with a door and the other end has an arcuate rack. The lever pivots intermediate its ends, and an electric clutch pivots the lever through a pinion meshed with the rack. In use of the dispenser, operation of the motor pivots the lever to urge the door open with a force determined by the slip force of the motor clutch, and a spring thereafter returns the door to its closed position. An obvious disadvantage of such a mechanism resides in the electric motor clutch, which adds complexity and expense to the unit.

Another type of ice dispenser mechanism of the gate type uses a solenoid to move the gate. This dispenser is somewhat similar to that in U.S. Pat. No. 3,211,338, except that a solenoid plunger connects directly with the lever to pivot the same and open the door. Although this arrangement is less complex than use of a clutch motor, a disadvantage resides in the fact that the solenoid exerts minimum forces on its plunger when the same is fully extended and the door closes the hopper opening. Consequently, should significant binding of the door occur due to pressure of ice thereagainst, the solenoid is often unable to develop sufficient forces to open the door.

OBJECT OF THE INVENTION

An object of the present invention is to provide an improved solenoid operated ice dispenser mechanism of the gate type, in which full solenoid power may be transferred to the gate to open the same even when the gate is initially stuck in a closed position.

SUMMARY OF THE INVENTION

In accordance with the present invention, a mechanism for dispensing ice through an opening in a container comprises a gate movable between a closed position blocking the opening and an open position unblocking the opening. A spring is coupled between a plunger of a solenoid and said gate, and when said solenoid is energized retraction of said plunger exerts a force on said gate through said spring to move said gate to its open position.

The mechanism includes means mounting said gate for movement between its open and closed positions, and an elongate lever pivotally mounted for rotation about one of its ends and connected with said gate at its opposite end. Said spring is connected between said plunger and a medial portion of said lever, so that when said plunger is retracted said spring, in one embodiment, is placed under tension, and in another embodiment is placed under compression, to rotate said lever about its one end to urge said gate toward its open position.

By virtue of the spring connecting said plunger and said lever, said plunger initially encounters minimum resistance to movement when said solenoid is first energized, at which point said plunger is extended and said solenoid exerts minimum forces thereon, and is therefore always able to move to its fully retracted position, whereat maximum forces are exerted on said plunger by said solenoid. Thus, even when said gate is stuck closed, said plunger exerts maximum forces on said gate to free the same.

The foregoing and other objects, advantages and features of the invention will become apparent upon a consideration of the following detailed description, when taken in conjunction with the accompanying drawings.

DETAILED DESCRIPTION

Figure 1:
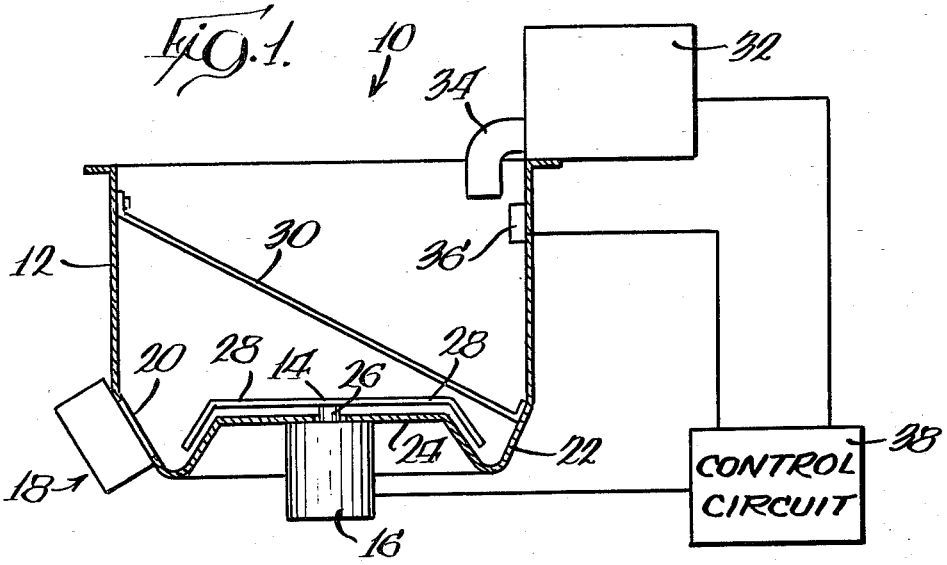
FIG. 1 is a side elevation view, partly in cross section, illustrating an ice dispenser of a type with which the dispenser mechanism of the present invention may be used.

FIG. 1 illustrates an ice dispenser of a type with which the ice dispenser mechanisms of the present invention may advantageously be used. As shown, an ice dispenser, indicated generally at 10, is conventionally comprised of a hopper, bin or tank 12 for storing a large mass of crushed, cracked, flaked or cubed ice, such as fifty pounds, and a rotary impeller or agitator 14 driven by an electric motor 16. An ice dispenser mechanism in accordance with the present invention, indicated generally at 18, is connected with a lower end of the hopper for accommodating controlled discharge of ice therefrom through a discharge opening 20.

Considering first the dispenser 10, the hopper 12 is essentially an open top tub, the major part of which comprises a main upper portion which may be of circular or other cross section, but preferably is of polygonal cross section as disclosed in U.S. Pat. No. 3,517,860 to facilitate maintaining the particles of ice in discrete, free flowing form. The bottom of the hopper has a circular depression comprising an annular trough 22 in which the discharge opening 20 is formed. The opening is spaced a short distance above the bottom of the trough, and the trough is provided at its bottom with melt water drain holes (not shown), so that only discrete particles of relatively dry ice will be discharged through the opening. The bottom of the hopper is closed by an end wall 24, so that ice to be discharged gravitates into and is confined within the trough.

The hopper may be made in any conventional manner, such as by deep drawing of sheet metal or the molding of plastics, and when completed is sheathed in insulation and provided with a removable insulated cover, all as is well known in the art.

The bottom wall 24 of the hopper is centrally apertured for upward, liquid sealed passage therethrough of a shaft 26 of the motor 16, the motor being suitably mounted on the wall exteriorly of the hopper. Fastened to the motor shaft within the hopper is the impeller 14 which has a plurality of radial arms 28 that generally follow the contour of the bottom wall, extend into the trough and engage the mass of ice in the hopper to cause the same to rotate. A rod 30 extends from side to side and top to bottom within the hopper and provides a fixed resistance against which the rotating mass of ice may be moved to facilitate agitation and separation thereof into discrete, free flowing particles. The motor 16 may comprise an electric gear motor coupled with the ice dispensing gate mechanism 18, such that the motor is operated for a short interval of time during operation of the gate mechanism to provide a free flow of ice particles therethrough.

To maintain a supply of ice in the hopper and to replenish ice discharged through the gate mechanism 18, an icemaker 32 has an ice outlet or ice discharge spout 34 in communication with the open upper end of the hopper. The icemaker may be of any conventional type, and provides crushed, cracked, flaked or cubed ice to the hopper. To control operation of the icemaker in order to maintain ice in the hopper at a selected level, a thermostat 36 is mounted on an inside wall of the hopper in proximity with the ice spout 34 and at the level at which the ice is to be maintained, and senses the presence or absence of ice therearound by means of the surrounding temperature. Since as ice fills the hopper it tends to build up higher near its point of entry, by positioning the thermostat thereat overfilling of the hopper is prevented. The thermostat is connected with a control system 38 for operating the icemaker and the agitator, such that upon ice occurring around the thermostat the agitator motor is energized to rotate the agitator and level the mass of ice within the hopper, whereupon icemaker operation is then continued or interrupted in accordance with the level of ice then being below or at least equal in level to the thermostat.

Figure 2:
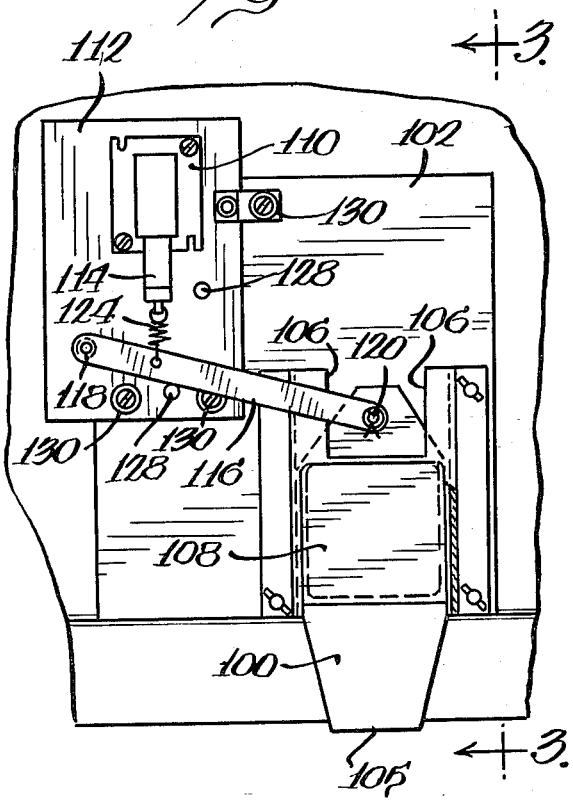
FIG. 2 is a front elevation view of one embodiment of solenoid operated ice dispenser mechanism in accordance with the teachings of the invention, showing the mechanism in a deactuated condition with a movable door or gate thereof closing an opening in an ice hopper.
Figure 3:
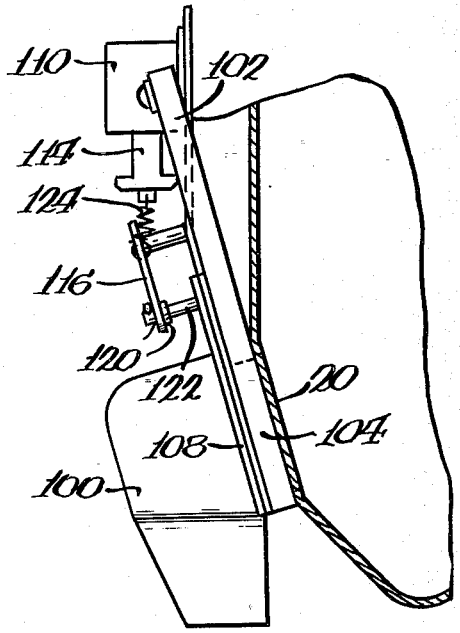
FIG. 3 is a cross section view taken substantially along the lines 3—3 of FIG. 2.

Referring to FIGS. 2 and 3, in accordance with the teachings of the present invention one embodiment of ice dispenser mechanism 18 is illustrated as comprising a dispensing chute or spout 100 mounted on a hopper gate plate 102, which in turn is fastened to the hopper 12 about the opening 20. The gate plate has an opening 104 in alignment with the hopper opening, whereby ice in the hopper may pass through the openings and into the chute for discharge from a lower end 105 of the chute. The chute forms with the hopper gate plate a pair of channels 106, and a gate or door 108, which may be a thin flat plate of sheet metal sharpened at its lower edge, is received and guided at its side edges in the channels for vertical reciprocation. The gate slides between the chute and the hopper gate plate between a lower position closing the openings 20 and 104, and an upper position uncovering the openings for passage of ice into the chute.

Motor means for moving the gate 108 between open and closed positions includes an electrically actuated solenoid 110 on a solenoid mounting plate 112, having a plunger 114. An elongate arm or lever 116 pivots at one end about a post 118 on the solenoid mounting plate, and is pivotally connected at an opposite end with the gate through a bushing 120 on a post 122 extending from the gate. To couple the solenoid plunger with the lever to rotate the lever about the post 118, thereby to raise and lower the gate, in accordance with the teachings of the invention a spring 124 is extended between the plunger and a medial point on the lever.

To limit the extent of movement of the lever 116, upper and lower level stops 128 are fastened to the solenoid mounting plate 112, and are preferably made of a resilient material to minimize noises associated with operation of the dispenser mechanism. To further minimize noise the solenoid mounting plate connects with the hopper gate plate through isolation grommets 130, which provide a resilient mounting for the plate 112, and the bushing 120 provides a pivoting action between the lever and the gate to eliminate rattling of the gate within the channels.

FIGS. 2 and 3 illustrate the ice dispenser mechanism in a relaxed or deenergized condition. Under this condition, the plunger 114 is fully extended from the solenoid, the spring 124 is relaxed, the lever or arm 116 is in its lower position and the gate 108 closes the openings to the hopper. Consequently, ice in the hopper is blocked from the dispensing chute 100.

Figure 4:
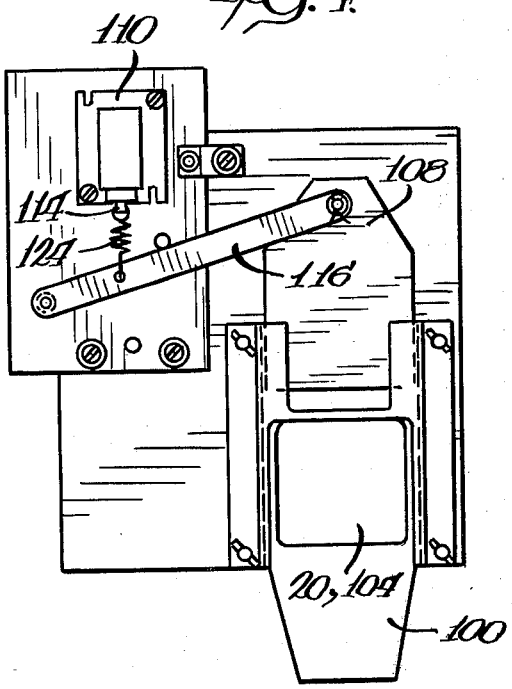
FIG. 4 is similar to FIG. 2, and shows the mechanism energized and the gate moved to a position unblocking the ice hopper opening.

To dispense ice through the chute, the solenoid 110 is energized by any suitable means, for example by an electrical switch actuated by a glass or other container position beneath the discharge end of the chute. Upon being energized, the solenoid retracts the plunger 114, as shown in FIG. 4, and pivots the arm 116, through the spring 124, to raise the gate 108 to its upper position to unblock the opening to the hopper for discharge of ice into the chute. To facilitate movement of ice through the hopper opening, upon energizing the solenoid the motor 16 may also be energized to rotate the agitator 14 and urge ice in the hopper through the opening. When a desired quantity of ice has been dispensed, the solenoid is deenergized to extend the plunger and lower the gate to its closed position.

The advantages obtained in connecting the solenoid plunger 114 with the lever 116 through the spring 124, as compared with directly connecting the plunger with the lever as contemplated by the prior art, may now be appreciated. In a first instance, the spring acts as a flexible link to transmit the force of the solenoid, the plunger of which is preferably operated in a vertical direction for extended life and lower friction, to the lever and gate 108, which may be in an inclined position. Thus, the spring provides a simplified means for converting motion in one plane to motion in another.

Figure 5:
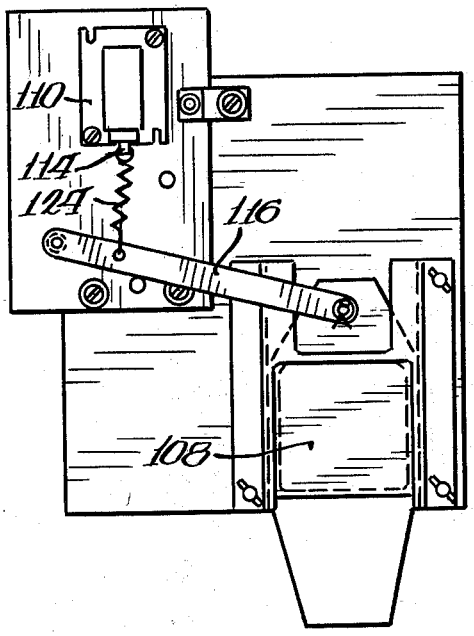
FIG. 5 is similar to FIG. 4, and shows the mechanism energized, but with the gate stuck in its closed position.

More importantly, however, proper selection of spring tension and solenoid force advantageously enable full solenoid power to be developed to move the gate 108 against any sluggishness, for example due to ice pressure thereagainst, which enhances opening of the gates even under adverse conditions. In this connection, and upon the solenoid being energized, as the plunger 114 is retracted any lack of movement of the lever 116 causes the spring 124 to be stretched, thereby increasing its pull on the lever. In an extreme case, as shown in FIG. 5, the plunger may be completely retracted with the gate remaining stuck in its closed position, which would cause maximum extension of the spring and substantially the full "sealed" or retracted force of the solenoid to be exerted on the lever to urge the gate open. Since the force exerted by a solenoid on its plunger increases as the plunger is retracted, and is several times greater when the plunger is substantially fully retracted than when the plunger is fully extended, increased forces are developed by the solenoid and exerted on the gate to open the same. By contrast, a solid linkage between the solenoid plunger and the lever under the condition of a stuck gate would cause the plunger to remain in its extended position, since the solenoid would not then be able to exert sufficient force on the plunger to free a reasonably well stuck gate. Thus, with the gate stuck closed the spring initially offers minimum resistance to retraction of the plunger, so that the plunger begins to retract, and then offers an increasing resistance as the solenoid simultaneously increases its retraction force on the plunger, with the result that the solenoid is able to completely retract the plunger and develop its full power potential to free the gate.

Figure 8:
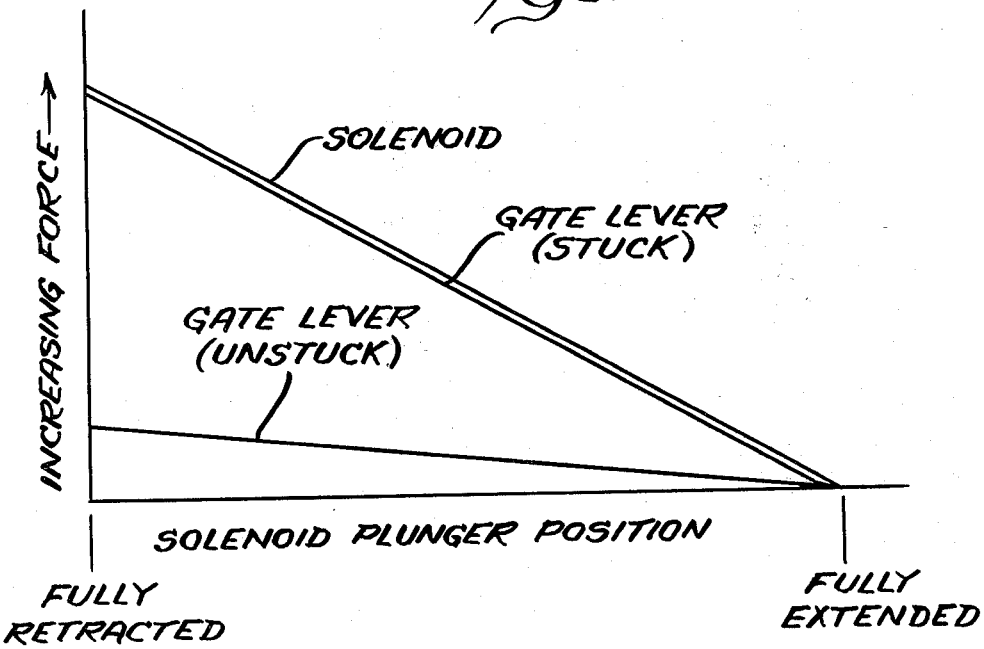
FIG. 8 is a graphical representation of the forces exerted by the solenoid on the solenoid plunger and on the movable gate for various positions of the plunger and for the conditions of the gate being stuck and unstuck.

FIG. 8 graphically illustrates the relationship of the forces exerted by the solenoid on its plunger, and of those exerted on the arm 116 by the spring, under the conditions of the gate being stuck and unstuck and for various extensions of the solenoid plunger. As may be seen, the forces exerted by the solenoid on the plunger, and by the spring on the gate arm, are a minimum when the plunger is fully extended, which occurs when the gate 118 is closed, and gradually increase to a maximum value when the plunger is fully retracted, under the condition where the gate is stuck closed. Consequently, should the gate bind, because of the spring the solenoid is able to develop maximum forces to free the gate. In the normal situation where the gate is not stuck, the spring is extended less and the forces exerted on the lever increase less significantly as the plunger is retracted.

An additional benefit obtained by the invention is that the spring 124 prevents burnout of the solenoid 110 in the event that the gate 108 remains closed after the solenoid is energized. Because of the spring, when the solenoid is energized the plunger is always completely retracted, which protects the solenoid against damage. Without the spring, should the gate remain stuck the plunger would not retract into the solenoid, and continued energization of the solenoid would result in its destruction.

Figure 6:
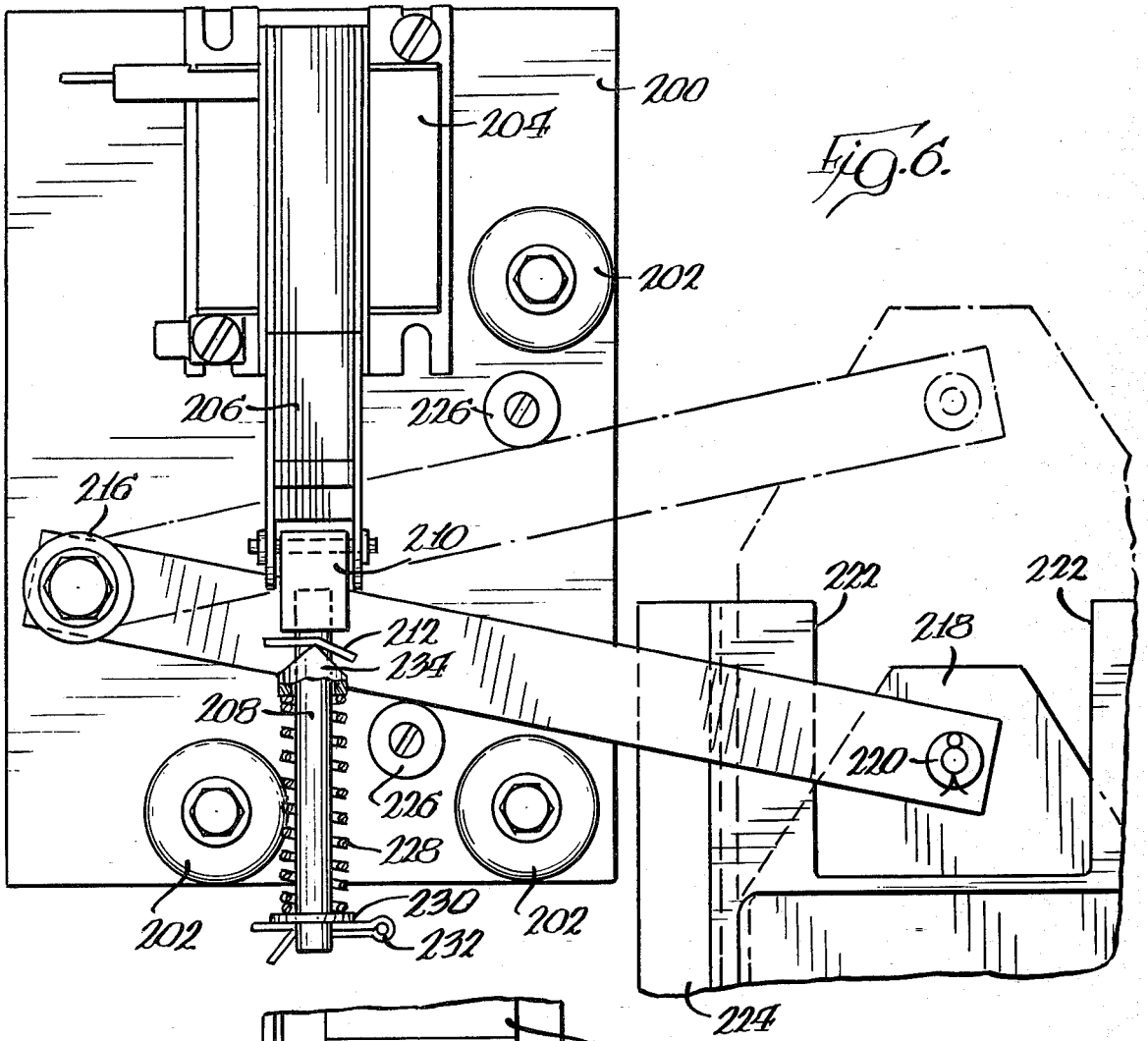
FIG. 6 is a front elevation view of another embodiment of solenoid operated ice dispenser mechanism in accordance with the teachings of the invention.
Figure 7:
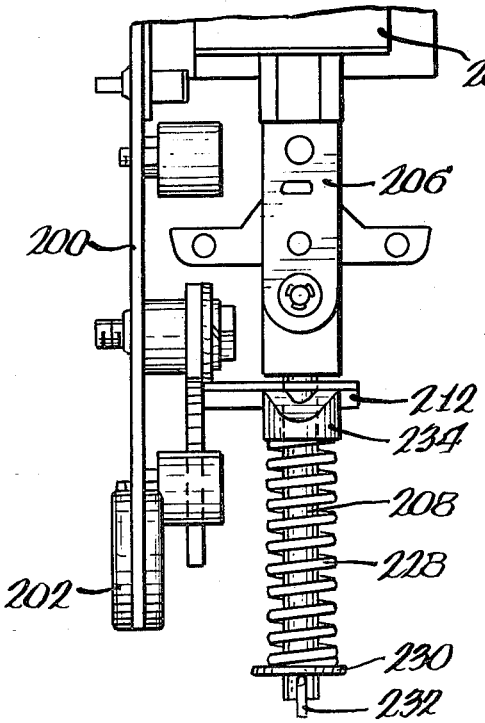
FIG. 7 is a side elevation view of the mechanism shown in FIG. 6.

FIGS. 6 and 7 illustrate another embodiment of ice dispenser mechanism in accordance with the teachings of the invention. The mechanism includes a plate 200 mountable on the hopper by means of bushings 202, and a solenoid 204 on the plate. A plunger 206 of the solenoid is coupled with a gate lift rod 208 by means of a clevis 210, and the gate lift rod extends through a passage in a bearing member 212 of a gate lift arm or lever 214. The lever is pivotally mounted on the plate at one of its ends by a bearing 216, and is pivotally connected at its opposite end to a gate or door 218 by a bearing 220. The gate is received at its side edges within channels 222 defined by an ice chute 224, and is reciprocable in the channels between a lower position closing an opening to the ice hopper and an upper position unblocking the opening. Stops 226 limit the extent of movement of the lever 214 about the bearing 216.

To couple the solenoid plunger 206 with the gate lift arm 214 to move the gate 218 between its open and closed positions, and yet to permit complete retraction of the plunger into the solenoid should the gate be stuck closed when the solenoid is energized, a spring 228 is positioned around the gate lift rod 208. A washer 230 is maintained on the gate lift rod by a cotter pin 232 and supports a lower end of the spring, and a gate lift rod bushing 234 at an upper end of the spring is slidable along the gate lift rod. An upper pointed end of the bushing contacts the bearing member 212, so that upward movement of the bushing pivots the lever 214 to open the gate 218.

Operation of the ice dispenser mechanism shown in FIG. 6 is much the same as that in FIG. 2, except that the spring 228 coupling the solenoid plunger with the gate lift arm is placed under compression during operation, and the forces exerted by the solenoid on its plunger and by the spring on the gate lift arm, for various extensions of the plunger, are as shown in FIG. 8. Thus, upon energization of the solenoid 204, retraction of the plunger 206 rotates the gate lift arm 208, through the spring, to exert a force on the lever 214 to urge the gate 218 to its open position. Should the gate be stuck closed when the solenoid is energized, then the spring 228, which is preferably in a relaxed condition in the absence of solenoid energization, initially presents minimum resistance to retraction of the plunger, so that the plunger may be completely retracted into the solenoid, whereupon maximum forces are then exerted on the gate to open the same. Consequently, the ice dispenser mechanism of FIG. 6 has all of the advantages of the dispenser in FIG. 2.

The invention thus provides improved ice dispenser mechanisms. By virtue of the solenoid plungers being coupled with the lever arms through springs, maximum solenoid power is transferred to the gates to open the same, even when they are in a stuck position. In addition, since the springs always ensure complete retraction of the solenoid plungers, should the gates remain stuck after the solenoids are energized, burnout of the solenoid coils is prevented.

While embodiments of the invention have been described in detail, various modifications and other embodiments thereof may be devised by one skilled in the art without departing from the spirit and the scope of the invention, as defined by the appended claims.

What is claimed is:

1. A mechanism for dispensing ice from a container having an opening accommodating passage of ice therethrough, said mechanism comprising gate means movable between a closed position for blocking the opening and an open position for unblocking the opening; motor means; and resilient coupling means coupling said motor means and said gate means for movement of said gate means by said motor means, said motor means moving between a first position whereat said gate means is closed and a second position whereat said gate means is normally open, and said resilient coupling means exerting an increasing force on said gate means to open the same as said motor means moves from said first to said second position, said resilient coupling means comprising a spring, said spring exerting minimum forces on said gate means to open the same when said motor means is in said first position and being placed under compression to exert increasing forces on said gate means to urge said gate means to its open position when said motor means moves from said first to said second position.

2. A mechanism as in claim 1, said motor means comprising a solenoid having a plunger, said resilient coupling means coupling said plunger and said gate means.

3. A mechanism as in claim 2, said gate means comprising a door for blocking and unblocking the container opening and a lever pivoted at one end and connected at an opposite end with said door, said resilient coupling means coupling said plunger with a medial portion of said lever for pivoting said lever about its one end to move said door between the positions blocking and unblocking the container opening.

4. A mechanism for dispensing ice from a container having an opening accommodating passage of ice therethrough, said mechanism comprising gate means movable between a closed position for blocking the opening and an open position for unblocking the opening; a solenoid having a plunger movable between extended and retracted positions, and a spring coupling said plunger and said gate means, said plunger when retracted exerting forces on said spring to move said gate means to its open position and when extended relieving said spring of forces for return of said gate means to its closed position, said spring being placed under compression upon retraction of said plunger.

5. A mechanism as in claim 4, said gate means including a door for blocking and unblocking the container opening and an elongate lever pivoted at a first point therealong and connected at a second point therealong with said door, said spring being coupled between said plunger and said lever for urging said lever in a direction of rotation about said first point, upon retraction of said plunger, which moves said door to the position unblocking the opening.

6. A mechanism for dispensing ice from a container having an opening accommodating passage of ice therethrough, said mechanism comprising a gate mounted for movement between a closed position for blocking the opening and an open position for unblocking the opening; a lever pivotally mounted at one of its ends and coupled at its opposite end with said gate for moving the same between its open and closed positions; an electrically operated solenoid having a plunger movable between extended and retracted positions; and a spring coupling said plunger with a medial portion of said lever, said plunger when retracted exerting forces on said spring and lever which urge said lever for rotation about its one end in a direction to urge said gate to its open position, said plunger when extended substantially relieving said spring of forces for movement of said gate to its closed position, wherein said spring is a coil spring and is compressed upon retraction of said solenoid plunger.

* * * * *